US009248692B2

(12) United States Patent
Effrem

(10) Patent No.: US 9,248,692 B2
(45) Date of Patent: Feb. 2, 2016

(54) WOOD BURNING APPARATUS

(75) Inventor: Timothy Effrem, Englewood, FL (US)

(73) Assignee: Timothy Effrem, Englewood, FL (US)

( * ) Notice: Subject to any disclaimer, the term of this patent is extended or adjusted under 35 U.S.C. 154(b) by 1089 days.

(21) Appl. No.: 12/926,611

(22) Filed: Nov. 30, 2010

(65) Prior Publication Data

US 2012/0132637 A1 May 31, 2012

(51) Int. Cl.
*H05B 3/42* (2006.01)
*B44B 7/00* (2006.01)
*B27M 1/06* (2006.01)

(52) U.S. Cl.
CPC ... *B44B 7/00* (2013.01); *B27M 1/06* (2013.01)

(58) Field of Classification Search
CPC ..... B44B 7/00; B27M 1/06; B26B 5/00; B26B 5/002; B26B 11/00; B26B 11/008; B43K 27/08; B43K 29/18
USPC ..... 219/240, 227, 233, 236, 482, 507, 540, 219/541
See application file for complete search history.

(56) References Cited

U.S. PATENT DOCUMENTS 236,972 A * 1/1881 Bell ..... 219/240
1,533,959 A * 4/1925 Wagner ..... 219/240
1,656,690 A * 1/1928 Blackburn ..... 219/236
1,955,863 A * 4/1934 Schmidt ..... 601/18
1,964,732 A * 7/1934 Homan ..... 606/191
1,994,994 A * 3/1935 Hampton ..... 219/239
2,004,580 A * 6/1935 Meyer ..... 219/230
2,101,912 A * 12/1937 Meyer ..... 219/221
2,112,068 A * 3/1938 Cole ..... 219/235
2,469,479 A * 5/1949 Shay ..... 219/240
2,476,612 A * 7/1949 Lobdell ..... 219/240
2,491,931 A * 12/1949 Raker et al. ..... 219/235
2,667,561 A * 1/1954 Schoenwald ..... 219/240
2,715,175 A * 8/1955 Jacobson ..... 425/282
2,727,132 A * 12/1955 Hills ..... 219/223
2,737,570 A * 3/1956 Aita ..... 219/235
2,740,036 A * 3/1956 Johnson ..... 439/481
2,772,339 A * 11/1956 Bennett et al. ..... 219/227
3,125,661 A * 3/1964 Alvarez et al. ..... 219/262
3,286,076 A * 11/1966 Finch ..... 219/230
3,316,385 A * 4/1967 Anton ..... 219/236
3,436,718 A * 4/1969 Knowles ..... 439/481
3,711,677 A * 1/1973 Cummins ..... 219/221
3,992,605 A * 11/1976 Kraus et al. ..... 219/233
4,441,013 A * 4/1984 Masreliez ..... 219/231
4,770,669 A * 9/1988 Allen et al. ..... 44/510
2007/0261174 A1* 11/2007 Barker ..... 7/160

* cited by examiner

*Primary Examiner* — Eric Stapleton
(74) *Attorney, Agent, or Firm* — Rouz Tabaddor

(57) ABSTRACT

Systems efficiently using heat to create a creative design using a wood burning pen are disclosed. The embodiments a wood burning pen equipped with two receiver tubes angled 0.5°-4° away from each other, two screws capable of tightening the contact between two contact rods and the receiver tubes, and a tip wire connecting the two contact rods. The contact rods are inserted into the receiver tube openings. The contact rods are tightened into place with the screws. The two receiver tubes conduct electricity through the body of the wood burning pen. Because of the screws contact with the receiver, the electricity travels through the contact rods, heating tip wire. The tip wire may then be used to create decorative designs in wood.

6 Claims, 5 Drawing Sheets

WOOD BURNING APPARATUS

FIELD OF THE DISCLOSURE

The present disclosure relates generally to a wood burning apparatus and, more particularly, to a wood decorating apparatus that is able to receive various contact rods, wire tips or filaments without contact rods from different manufacturers and standards, and furthermore, is able to create an adjustable contact connection.

BACKGROUND

It is well known that heat may be used to make designs, patterns, and words on wood. Various instruments are available to assist the user in decorating wood with burn patterns. Despite these products, there is still a need for further enhancements.

A typical instrument used to burn decorative designs into wood is manufactured by Leisure Time Products. A description of the products may be found on their website and related to "replaceable tip pens." The instrument has a body made of aluminum. The instrument heats a filament with electricity from electrical wires. At the opposite end of the electrical wires, the instrument has two openings for receiving two contact rods. The contact rods are attached to a filament. The filament heats up, allowing a user to burn designs into wood.

The contact rods are simply pushed into the openings. The contact rods must be a very specific size, the size of the openings. The contact rod diameter must be small enough to allow insertion into the openings, but large enough to provide contact with the walls of the openings. Because of this, the contact rods usually do not have sufficient contact to efficiently and consistently conduct electricity through the filament. In fact, the contact rods with the attached filament often fall out during use.

One skilled in the art will be able to recognize that these devices present some deficiencies.

SUMMARY OF THE INVENTION

A wood burning device is disclosed which includes a mechanical and physical interface between a body part of the wood burning device and the contact rod/tip wire which is received by the wood burning device. The wood burning device is generally used in the field of embossing art into various material surfaces.

In one disclosed embodiment the wood burning apparatus includes a novel interface which advantageously allows users to purchase and use tip parts/contact rods from diverse manufacturers using diverse mechanical and physical standards for the interface.

In another disclosed embodiment the wood burning apparatus includes a fastening mechanism which is able to fasten various tip wire/contact rods to the wood burning device and to create a clean contact point.

In another disclosed embodiment the wood burning apparatus includes a first receiver tube having a first channel portion and a second receiver tube having a second channel portion. Wherein the horizontal axis of the first channel portion is offset at angle with respect to the horizontal axis of the second channel portion, so that the horizontal axis of the channels are not parallel. Furthermore, the first channel portion and the second channel portion are configured to have a first portion which is larger in diameter than a second portion.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, reference numerals designate corresponding parts throughout the views.

FIG. **6*a*-6*j*** is a top view of a variety of different tip wires.

Figure 7:
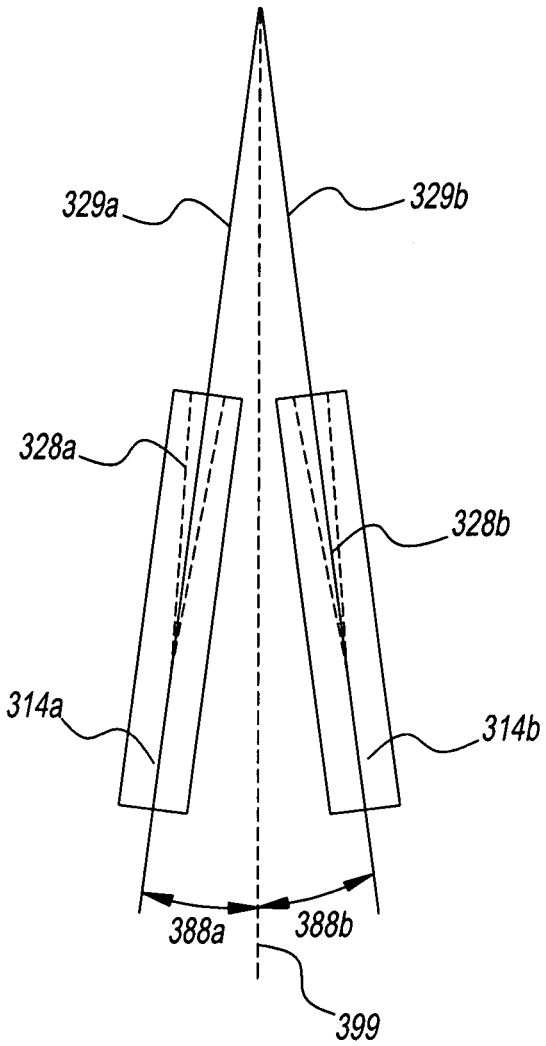

FIG. 7 illustrates a top view of the receiver tube and channel portion and angle of offset of an exemplary embodiment.

Figure 8:
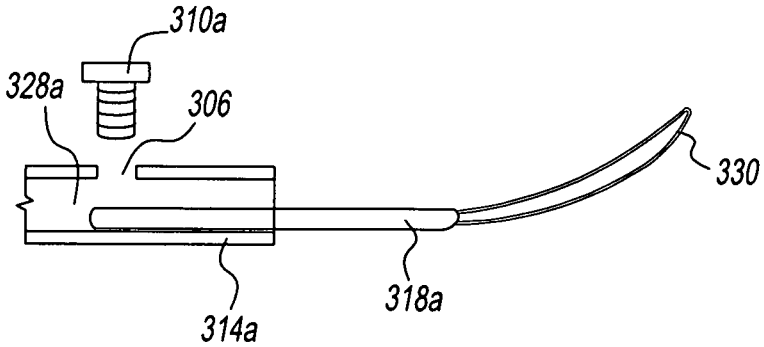

FIG. 8 illustrates a sectional view of the receiver tube and channel.

DETAILED DESCRIPTION OF THE EMBODIMENTS

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Figure 1:
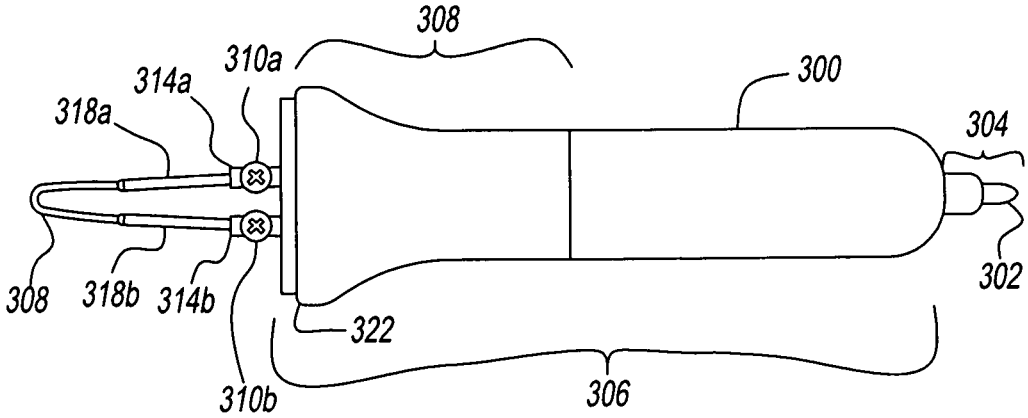
FIG. 1 is a side view of an exemplary wood burning pen.
Figure 2:
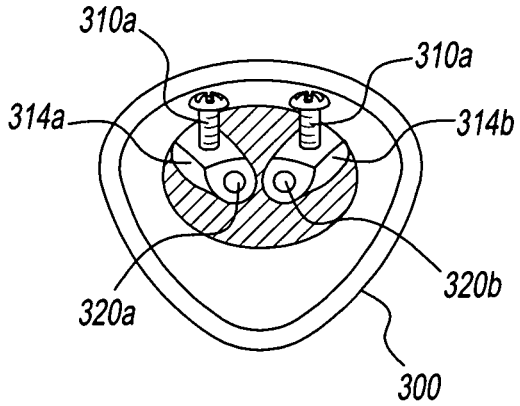
FIG. 2 is an exploded front view of the exemplary wood burning pen.

Turning now to the drawings, FIGS. 1 and 2 illustrate an exemplary embodiment of a wood burning device 300. In a preferred embodiment, the wood burning device would be the BURNMASTER® tool which is manufactured by Wood Carvers Supply. However, it should be appreciated that this is merely an exemplary embodiment and various alternatives, modifications and equivalents should be covered. The wood burning device 300 may have various shapes and configurations, however, in the exemplary embodiment the shape is similar to the shape of a pen which is easily able to be held and used by a user. Generally, the wood burning device 300 is used to create various designs on wooden product(s). Accordingly, a number of factors, e.g. weight, shape, ability to have an insulating layer where the user grips, may be considered to create the shape and size of the wood burning device.

The wood burning device 300 includes a first end 302 which has a connector 304, known in the electronics industry as an RCA connection, which is able to receive a current of electricity and allow the electric current to flow through wires within the body of the wood burning device until the current is transmitted through the two receiver tubes **314*a* and 314*b* to the tip wire 330. The tip wire 330 is then heated to a temperature which will allow the tip wire to burn a piece of wood, when the piece of wood comes in contact with the tip wire. It should be appreciated that various distributors/manufacturers of the tip construct the tip wire 330 in various manners. For example, the tip wire may include contact rods 318*a* and 318*b* or may not. Furthermore, the angle between the contact rods 318*a* and 318*b*** varies based on different manufacturers. Also, the diameter of the contact rods and/or tip wire may also vary. All of these various factors make it difficult for other wood burning devices to receive tip wires from various distributors. The present invention includes a novel configuration which will allow various tip wires/contact rods to be received, and more importantly, tightly secured by the wood burning pen.

Figure 3:
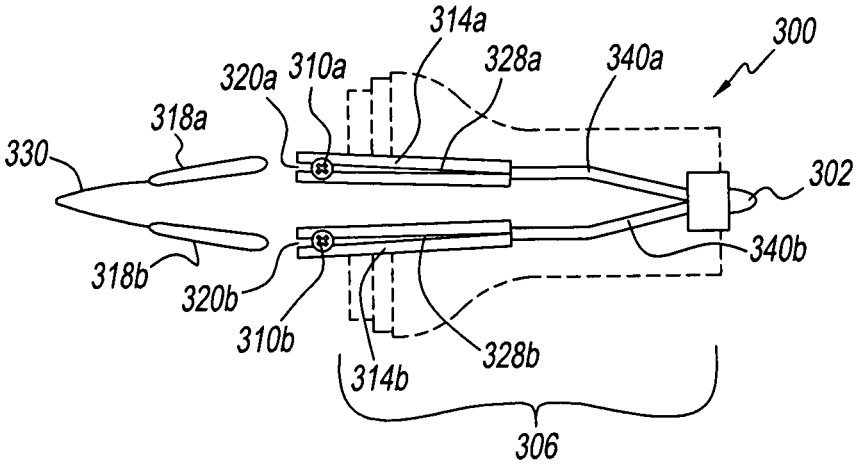
FIG. 3 is a cross-section of the top view of the exemplary wood burning pen.

As shown in FIG. 3, one end of the wood burning device 300 is configured to receive an electric current from a powering unit (not shown). The powering unit (i.e. a power regulated transformer) must provide DC power to the wood burning device. A transformer within the powering unit may receive AC power, but the output side which powers the wood burning device must be DC. The connector 304 is able to connect with a powering unit to receive an electric current. It should be appreciated that FIG. 3 shows the connector 304 as being a male member. However, the wood burning device 300 could instead have a female member which is able to connect to a male member of the powering unit member or other connections known to those familiar with the art. The powering unit could comprise of a number of different devices that provide an electric current (i.e. a battery unit, etc).

The case 306 may consist of a heat-resistant plastic or other similar material, preventing burns to a user's hand. Additionally, the lower portion of the case 306 may be encased in a soft and pliable cover, similar to a finger-grip sleeve on a pencil, providing further protection against burns and improving grip and comfort. The cover 308 may be made of a heat-resistant plastic, rubber, or other similar material. The cover 308 provides the location for the user's fingertips along the wood burning device 300. The cover 308 also serves to provide additional comfort to the user's fingers as the user grips the wood burning device 300. The elongated case 306 and the cover 308 provide for a triangular protrusion 322, preventing the user's fingertips from sliding down to the hot tip wire 330. In one embodiment, the case 306 provides for a triangular ergonomic grip through the shape of the pen, reducing fatigue and naturally putting the tip in the same position whenever you pick up the pen. This eliminates repositioning when picking up the pen for use.

FIG. 3 also illustrates two receiver tubes 314*a*, 314*b* which are able to receive two contact rods 318*a*, 318*b* joined by a tip wire 330. The contact rods 318*a*, 318*b* are secured in the receiver tubes 314*a*, 314*b* by a fastening mechanism 310*a*, 310*b*. In the preferred embodiment the fastening mechanism is comprised of two screws (however, it should be noted that one screw would also be functional) The receiver tubes 314*a*, 314*b* each include an opening portion 320*a*, 320*b* (shown in FIG. 2) which are able to receive the contact rods 318*a*, 318*b* of the tip wire 330.

FIG. 2 illustrates the front view of the wood burning pen which shows the axial view of the openings 320*a*, 320*b* of the receiver tubes 314*a*, 314*b*. It should be appreciated, in an exemplary embodiment, the first receiver tube 314*a* and the second receiver tube 314*b* are angled to be offset with respect to the horizontal axis of the other receiver tube. However, as discussed later it is also important that the channel portion of each of the receiver tubes be offset at an angle with respect to each other. It should be appreciated, that in one embodiment the receiver tubes could be parallel and the channel portions of each of the receiver tubes are offset.

The receiver tubes may consist of an efficient electricity-conducting metal such as nickel-plated copper, aluminum or other conductive material either un-plated or plated with gold or nickel or other conductive metals. It should be noted that in the exemplary embodiment, the openings 320*a*, 320*b* are offset from each other so that, as shown in FIG. 2, the channels 328*a*, 328*b* of the openings 320*a*, 320*b* are not parallel to each other. This can be accomplished by either configuring the first and second receiver tubes 314*a*, 314*b* to be offset from the horizontal axis or just by offsetting the openings and their respective channels 328*a*, 328*b* to be offset from the horizontal axis. However, it in the preferred embodiment, the first receiver tube 314*a* and the second receiver tube 314*b* are bent to create the offset. Therefore a portion of the receiver tubes may be parallel, but at least a portion of the receiver tube should be offset. In the preferred embodiment, the bend could start at the portion where the first and second channels are located. As shown in FIG. 7, in the preferred embodiment, the channels are offset 388*a*, 388*b* from the horizontal axis by about 0.5 degrees to about 2 degrees, or the first channel 328*a* could be offset from the second channel 328*b* by about 1 degree to about 4 degrees. However, it should be appreciated that the objective is to offset the channels so as to accommodate the non-adjustable offset contact rods found in some (e.g. Colwood brand) burning tips because these tips have a plastic guide body that firmly holds the contact rods at a precise offset. It is contemplated that by offsetting the channels 328*a*, 328*b* the openings 320*a*, 320*b* may be large and capable of accepting Colwood brand and similar style tips.

Furthermore, it should be appreciated that that the openings 320*a*, 320*b* each allow the contact rods to be inserted into the channels 328*a*, 328*b*. This allows a user to slide the contact rods 318*a*, 318*b* or tip wire 330 inside the channel so that the tip wire is the desired distance out of the wood burning pen.

As mentioned above, the first receiver tube 314*a* and second receiver tube 314*b* may be parallel or also offset to one another. In the preferred embodiment, as depicted in FIG. 2, the first receiver tube 314*a* is placed at an angle away from the horizontal axis of the second receiver tube 314*b*. In the preferred embodiment, the offset is accomplished by bending the metal receiver tube. The angle may be between about 0.5°-3° from the horizontal axis. In the preferred embodiment, the angle is about 2.5° to 2.7° to be the preferable angle of distance separating the first receiver tube 314*a* and the second receiver tube 314*b*. As discussed above, angling the channels 328*a*, 328*b* allows the wood burning device to receive via the openings 320*a*, 320*b* various contact rods or tip wires which are manufactured by various companies.

FIG. 3 is an exploded view of the receiver tubes and further exemplifies the internal design of the receiver tubes. The first receiver tube 314*a* is coupled to the male electric connector via wires 340*a*. The second receiver tube 314*b* is coupled to outer portion of the connector via wires 340*b*.

The first receiver tube 314*a* may receive a contact rod 318*a* or a tip wire without a contact rod attached. The contact rod may be made of copper or some other metal able to conduct electricity. The contact rod 318*a* is joined to another contact rod 318*b* by a tip wire 330. The tip wire 330 is preferably made from nichrome, but may be made from various heat and electric-conducting materials.

Electricity simultaneously flows from two separate insulated contacts on the inside and outside of connector 304 through wires 340*a* and 340*b* through the first and second receiver tubes 314*a* and 314*b*, through the first contact rod 318*a* and through a second contact rod 318*b* and finally terminating at the tip wire 330.

As noted above, the first receiver tube 314*a* is angled 0.5-6° away from the second receiver tube 314*b*, allowing the receiver tubes to accept a variety of hot wire tip systems such as Colwood and provide a greater ability to heat the tip wire 330 of various systems and standards.

Figure 5:
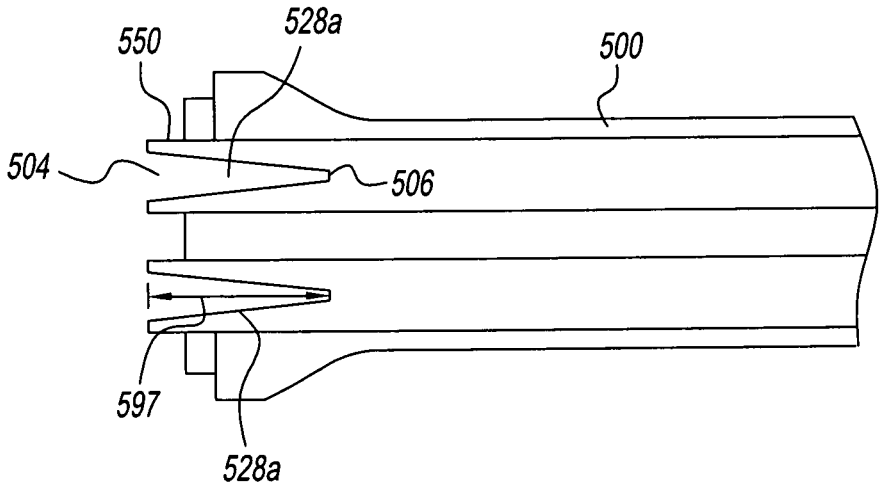
FIG. 5 is a side view of the channel portion with a graduated slope.
Figure 6A:
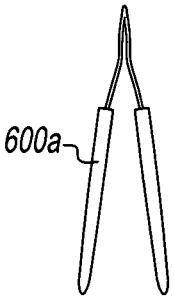
Figure 6B:
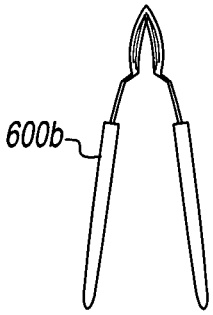
Figure 6C:
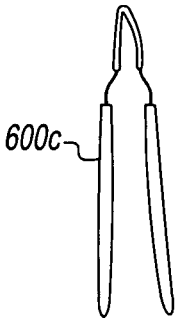
Figure 6D:
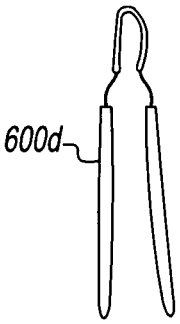
Figure 6E:
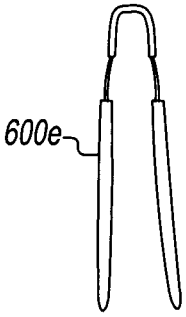
Figure 6F:
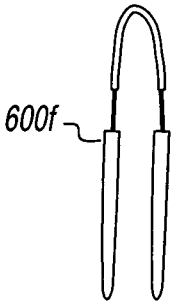
Figure 6G:
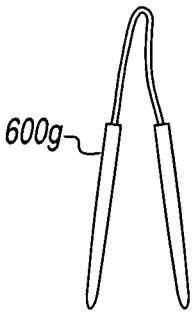
Figure 6H:
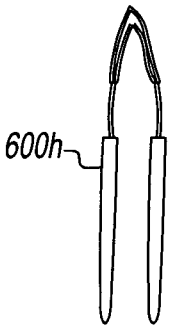
Figure 6I:
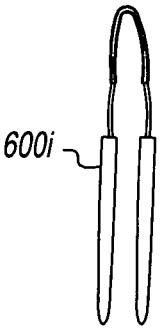
Figure 6J:
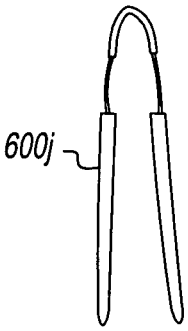

The design of the inside of the receiver tubes 314*a*, 314*b* is also advantageous. The opening 320*a* of the first receiver tube 314*a* and the opening 320*b* of the second receiver tube 314*b* may be graduated in diameter. The diameter of the receiver tube openings 320*a*, 320*b* may gradually shrink through the channels 328*a* and 328*b* or may have a "stepped portion". For example, the diameter of the receiver tube channel 328*a*, 328*b* may gradually shrink from 2.7 mm at the openings to 2.4 mm further down the channel with a depth of 10 mm. In another exemplary embodiment, the diameter of the receiver tube openings may have a sudden change in diameter, as shown in FIG. 5 at 528. Both mechanisms, gradual and sharp reduction in receiver tube opening diameter, allow the contact rods 314 to fit tightly within the tubes.

Figure 4:
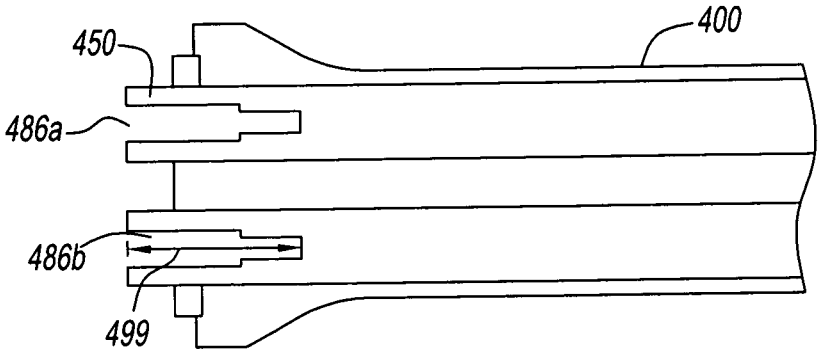
FIG. 4 is a side view of the channel portion with a step portion.

FIGS. 4 and 5 show an exemplary channel having a "step portion" and an exemplary channel having a conical shape respectively. FIG. 4 illustrates a wood burning apparatus 400 having receiver tubes that have a stepped portion located somewhere along the depth 499 of the openings 486*b* or 486*a*. FIG. 5 shows the channel portions 528*a* and 528*b* of the receiver tube as having a graduated shape, e.g. conical, which gradually reduces in diameter along the depth 597 of the channel portions.

A tight-fit between the receiver tubes 314*a*, 314*b* and the contact rods 318*a*, 318*b* or receiver tubes and tip wire alone is essential for the efficient flow of electricity, and thus, the efficient conduction of heat. In order for electricity to be conducted efficiently, the two metals, the metal of the receiver tube 312, 316 and the metal of the contact rods 314, must be in very close contact. The graduated design of the receiver tube opening shown in FIG. 5 provides for this close contact and maintains this close contact on various contact rods and wire designs and standards. In another exemplary embodiment shown in FIG. 4, the diameter of the openings 486*a*, 486*b* are about 2.75 mm for the first 10 mm of depth and then the diameter shrinks or gradually reduces to 2.4 mm for the final 25.5 mm of depth 597.

The screws 310*a*, 310*b* also assist with providing a tight fit between the receiver tubes and the contact rods or tip wire without receiver tubes.

Returning to FIG. 2, two screws are received by the receiver tubes 312, 316. The screws 310*a*, 310*b* can be screwed through the top side of the receiver tube and into the receiver tube openings 306 (as shown in FIG. 8). The screws 310*a*, 310*b* may be tightened after the contact rods have been inserted in the tube openings 320*a*, 320*b*. It should be appreciated because of the novel design, once the screw 310*a* is inserted into the openings 306, a fulcrum effect is created. That is, the contact point where the screw meets the contact rod 314*a* is pressed downward while the other portions of the contact rod (or tip wire) on each side are pushed upwards. Therefore, creating more contact points between the tip wire/contact rods and the receiver tube. In the preferred embodiment the screws are made of stainless steel and the diameter of the screw is about 3 mm (and ranging from 2.5 mm to about 3.5 mm. Also, in the preferred embodiment, the opening 306 should have a larger diameter than the diameter of the channel portion 328*a*. The novel design achieves and maintains positive and secure contact on tip wire (without contact rods) down to 22AWG. Moreover, this design eliminates the possibility of the wire slipping past the screw (i.e. on the side of it) and not being secured.

The screws 310*a*, 310*b* serve two functions. First, when the user tightens the screws into the receiver tubes 314*a*, 314*b* after inserting the contact rods into the receiver tube openings 320*a*, 320*b*, the screws 310*a*, 310*b* are pushing the bottom of the contact rods against the bottom of the receiver tubes as shown in FIG. 8. The screws 310*a*, 310*b* ensure that the contact rods are in constant and tight contact with the receiver tubes. Thus, electricity is able to flow freely from the receiver tube through the contact rods, allowing the tip wire joining the contact rods to heat efficiently.

The screws also serve the purpose of cleaning the contact point between the contact rods or tip wire only without contact rods and the receiver tubes. When the user tightens the screws into position through the receiver tubes the screws will make initial contact with the contact rods. As the user continues to tighten the screws the screws will grind onto the contact rods, removing all dirt and particles from the surface of the contact rods. This provides a fresh contact point on the contact rods. Electricity flows more freely when there is no particulate matter or micro oxidation along its path. Thus, by cleaning the contact point on the contact rods with the screws electricity flows more freely through the screws to the contact rods, heating the tip wire more efficiently and consistently.

The tip wire maybe in a variety of different sizes designed for different decorative designs. Such examples may be seen as 600*a-j* in FIG. 6.

Although exemplary embodiments have been shown and described, it will be clear to those of ordinary skill in the art that a number of changes, modifications, or alterations to the disclosure as described may be made. For example, although a variety of tip wires are shown as 600*a-j* in FIGS. 6*a-j*, certain other shapes and sizes may be contemplated for specific design projects. All such changes, modifications, and alterations should therefore be seen as within the scope of the disclosure.

It should be appreciated that various embodiments provide various advantages, amongst others, including a mechanical and physical interface between a body part and a tip part of a handheld apparatus characterized as a pen and used in the field of embossing art into various material surfaces by producing and concentrating heat at a point of contact with said surface. It should be appreciated that there are a number of novel features which are novel on their own and/or also novel in various combinations. For example, the present invention includes a wood burning apparatus which includes two receiver tubes each having a channel portion which, for at least a portion of their length, is offset so that the channel portions are not parallel. The wood burning apparatus also includes an attachment means to create a tight fit with various standard of tip wires and tip wires with contact rods. The wood burning apparatus also includes a receiver tube having a diameter which is decreased from the opening of the channels of the receiver tube until the end of the channels. The channel portion diameter with respect to the opening portion which receives the screws.

What is claimed is:

1. A wood burning apparatus, comprising:

an elongated body having a first end and a second end;

a first contact rod and a second contact rod, wherein the contact rods are joined by a tip wire;

a first receiver tube located at the first end of the body and able to receive the first contact rod, wherein the first receiver tube has a first channel portion which includes a first stepped portion within the first channel portion that reduces the diameter of the first channel portion at the location of the stepped portion;

a second receiver tube located at the first end of the body and able to receive the second contact rod, wherein the second receiver tube has a second channel portion which includes a second stepped portion within the second channel portion that reduces the diameter of the second channel portion at the location of the second stepped portion;

a first fastening mechanism which is received by the first receiver tube and able to secure the first contact rod to the receiver tube and creates a fulcrum effect around the first stepped portion that creates multiple contact points between the first contact rod and the first channel;

a second fastening mechanism which is received by the second receiver tube and able to secure the second contact rod to the receiver tube and creates a fulcrum effect around the second stepped portion that creates multiple contact points between the second contact rod and the second channel;

a connector portion attached to the body which is able to connect to an electrical power source and allow an electric current to flow through the first and second receiver tubes; and wherein the horizontal axis of the first channel portion and the horizontal axis of the second channel portion are not parallel during heating of the tip wire.

2. The wood burning apparatus of claim 1, wherein the contact rods may be inserted into the first channel of the first receiver tube and the second channel of the second receiver tube.

3. The wood burning apparatus of claim 2, wherein the first and second fastening mechanisms are screws and the screws may be tightened through an opening in the first and second receiver tubes respectively.

4. The wood burning apparatus of claim 1, wherein the first channel portion and the second channel portion is graduated in diameter.

5. The wood burning apparatus of claim 1, wherein a lower portion of the elongated body is covered in a soft pliable material designed to resist heat and aid in the comfort of a user using the wood burning apparatus.

6. The wood burning apparatus of claim 1, wherein the first channel portion and the second channel portion include a first horizontal axis and a second horizontal axis respectively, and the first horizontal axis is about 1 to 4 degrees from the second horizontal axis.

* * * * *